US009283600B2

(12) United States Patent
Yamane et al.

(10) Patent No.: US 9,283,600 B2
(45) Date of Patent: Mar. 15, 2016

(54) PLUG FOR HOT PIPE MAKING

(71) Applicant: NIPPON STEEL & SUMITOMO METAL CORPORATION, Chiyoda-ku, Tokyo (JP)

(72) Inventors: Kouji Yamane, Tokyo (JP); Kazuhiro Shimoda, Tokyo (JP); Tomio Yamakawa, Tokyo (JP); Yuji Inoue, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days.

(21) Appl. No.: 14/415,050

(22) PCT Filed: Aug. 16, 2013

(86) PCT No.: PCT/JP2013/071995

§ 371 (c)(1),
(2) Date: Jan. 15, 2015

(87) PCT Pub. No.: WO2014/030593

PCT Pub. Date: Feb. 27, 2014

(65) Prior Publication Data

US 2015/0183010 A1 Jul. 2, 2015

(30) Foreign Application Priority Data

Aug. 24, 2012 (JP) ..... 2012-185033

(51) Int. Cl.
*B21B 25/00* (2006.01)
*B21B 19/04* (2006.01)

(52) U.S. Cl.
CPC ..... *B21B 25/00* (2013.01); *B21B 19/04* (2013.01)

(58) Field of Classification Search
CPC ..... B21B 19/04; B21B 25/00
USPC ..... 72/96, 97, 208, 209, 462, 478, 481.1
See application file for complete search history.

(56) References Cited

U.S. PATENT DOCUMENTS 1,815,427 A * 7/1931 Bark et al. ..... 72/463
1,951,087 A * 3/1934 Dunn ..... 72/124

(Continued)

FOREIGN PATENT DOCUMENTS

CN 1929933 3/2007
CN 201357497 12/2009

(Continued)

OTHER PUBLICATIONS

International Search Report dated Sep. 10, 2013 issued in corresponding PCT Application No. PCT/JP2013/071995 [with English Translation].

(Continued)

*Primary Examiner* — David B Jones
(74) *Attorney, Agent, or Firm* — Kenyon & Kenyon LLP

(57) ABSTRACT

A plug for hot pipe making includes a plurality of plug pieces which is attachable to and detachable from one another, and a connection member which connects the plug pieces by a magnetic force. One of the plug pieces connected to each other includes a column-shaped portion which extends in an axis direction of the plug for hot pipe making, and the other includes a joining hole which extends in the axis direction of the plug for hot pipe making and into which the column-shaped portion is inserted. The connection member is a permanent magnet which is attached to at least one of the column-shaped portion and the joining hole.

14 Claims, 8 Drawing Sheets

(56) References Cited

U.S. PATENT DOCUMENTS

| | | | | | |
|---|---|---|---|---|---|
| 3,918,284 | A | * | 11/1975 | Reiley et al. | 72/97 |
| 4,022,043 | A | * | 5/1977 | Chevet | 72/97 |
| 4,466,265 | A | * | 8/1984 | Wessel | 72/97 |
| 5,778,714 | A | * | 7/1998 | Katsumura et al. | 72/97 |
| 7,506,526 | B2 | * | 3/2009 | Yamakawa et al. | 72/97 |

FOREIGN PATENT DOCUMENTS

| | | |
|---|---|---|
| CN | 201417132 | 3/2010 |
| JP | 58-167004 | 10/1983 |
| JP | 60-137511 | 7/1985 |
| JP | 61-177702 | 11/1986 |
| JP | 62-207503 | 9/1987 |
| JP | S63-095604 | 4/1988 |
| JP | 01-289504 | 11/1989 |
| JP | 2000-167606 | 6/2000 |
| JP | 2008-229648 | 10/2008 |
| JP | 2009-125785 | 6/2009 |

OTHER PUBLICATIONS

Office Action dated Aug. 24, 2015 issued in related Chinese Application No. 201380040571.1 [with English Translation].

* cited by examiner

PLUG FOR HOT PIPE MAKING

This application is a national stage application of International Application No. PCT/JP2013/071995, filed on Aug. 16, 2013, which claims priority to Japanese Patent Application No. 2012-185033, filed on Aug. 24, 2012, each of which is incorporated by reference in its entirety.

TECHNICAL FIELD OF THE INVENTION

The present invention relates to a plug for hot pipe making (hereinafter, simply referred to as a plug), and particularly, relates to a plug included in a piercing machine (piercer) and an elongator.

RELATED ART

A Mannesmann pipe making process is widely used as a manufacturing method for a seamless metal pipe. In the Mannesmann pipe making process, a round billet heated at approximately 1200° C. is piercing-rolled by a piercing machine (piercer). The piercing machine includes a pair of inclined rolls and a plug. The plug is disposed on a pass line between the pair of inclined rolls. In the piercing machine, the round billet is pushed into the plug while rotating in the circumferential direction of the round billet due to the rotation of the inclined rolls, the round billet is piercing-rolled, and thus, a hollow pipe stock (hollow shell) is formed. In addition, an elongator drawing-rolls the hollow pipe stock if necessary, and thus, a diameter of the hollow pipe stock is increased and the thickness thereof is thinned. The elongator includes a configuration similar to the piercing machine, and includes a pair of inclined rolls and a plug.

As described above, since the plug pierces the round billet having a high temperature and increases the diameter thereof, the plug obtains a high temperature and a high contact pressure from the round billet. Accordingly, the surface of the plug becomes worn or seized. Particularly, since a head portion of the plug comes into contact with the round billet from the front surface of the round billet, a portion of the head portion of the plug may be melted and scraped off. That is, a portion of the plug may be eroded.

If the eroded plug is used in hot pipe making such as the piercing-rolling or the drawing-rolling, scratches are easily formed on the inner surface of the piercing-rolled or drawing-rolled round billet (hollow pipe stock). Accordingly, if the head portion of the plug is eroded, even when a plug main body other than the head portion is not eroded, the plug should be exchanged.

Therefore, in Patent Documents 1 to 5 below, technologies are disclosed in which the head portion of the plug is divided from the plug main body to be a separate body, and a material having superior wear resistance, seize resistance, and erosion resistance is used for the head portion.

In a plug disclosed in Patent Document 1, a tip portion of the plug is formed of Nb base alloy. Moreover, the tip portion is fixed to a plug main body by shrinkage fitting.

In a plug disclosed in Patent Document 2, a tip portion of the plug is formed of molybdenum or molybdenum alloy. In addition, the tip portion is fixed to a plug main body by shrinkage fitting or bonding.

In a plug disclosed in Patent Document 3, a tip portion of the plug is formed of ceramic such as $ZrO_3$. In addition, the tip portion is fixed to a plug main body by shrinkage fitting or bonding.

In a plug disclosed in Patent Document 4, a tip portion of the plug is formed of heat-resistant alloy having a high melting point and high strength. In Patent Document 4, the mounting method of the tip portion is not particularly described.

In a plug disclosed in Patent Document 5, a tip portion of the plug is formed of a ceramic. Moreover, the tip portion is interposed by a holding member using a bolt, screwed into the plug main body, and fixed thereto in a state where the tip portion is fixed by a mounting member.

PRIOR ART DOCUMENTS

Patent Document

[Patent Document 1] Japanese Unexamined Patent Application, First Publication No. H01-289504

[Patent Document 2] Japanese Unexamined Patent Application, First Publication No. S62-207503

[Patent Document 3] Japanese Unexamined Patent Application, First Publication No. S60-137511

[Patent Document 4] Japanese Unexamined Patent Application, First Publication No. S63-95604

[Patent Document 5] Japanese Unexamined Patent Application, First Publication No. 2000-167606

[Patent Document 6] Japanese Unexamined Patent Application, First Publication No. S58-167004

DISCLOSURE OF THE INVENTION

Problems to be Solved by the Invention

In the technologies of the above-described Patent Documents 1 to 5, the tip portion of the plug is formed of a material having superior erosion resistance, and thus, a life span of the plug can be lengthened. However, in the technologies of Patent Documents 1 to 5, the tip portion of the plug is fixed to the plug main body by shrinkage fitting, a bonding agent or a mounting member. Accordingly, in the technologies of Patent Documents 1 to 5, if the tip portion of the plug is eroded or the plug main body is eroded, it is difficult to exchange only the tip portion or only the plug main body of the plug (that is, maintenance becomes difficult).

The present invention is made in consideration of the above-described circumstances, and an object thereof is to provide a plug for hot pipe making in which a partial exchange is easily performed and maintenance becomes easier.

Means for Solving the Problem

The present invention adopts the following means to solve the problems and to achieve the related object.

(1) According to an aspect of the present invention, there is provided a plug for hot pipe making which is used in hot pipe making of a seamless pipe, the plug including: a plurality of plug pieces which is attachable to and detachable from one another; and a connection member which connects the plug pieces by a magnetic force, in which one of the plug pieces connected to each other includes a column-shaped portion which extends in an axis direction of the plug for hot pipe making, and the other includes a joining hole which extends in the axis direction of the plug for hot pipe making and into which the column-shaped portion is inserted, and the connection member is a permanent magnet which is attached to at least one of the column-shaped portion and the joining hole.

According to this configuration, since the plug pieces are connected to each other by the magnetic force, the plug pieces are easily attached to and detached from each other. That is, a partial exchange of the plug for hot pipe making is easily performed.

(2) In the plug for hot pipe making according to (1), cross-sectional shapes of the column-shaped portion and the joining hole may be circles.

According to this configuration, the plug pieces connected by the magnetic force can freely rotate around the axis of the plug for hot pipe making. As a result, for example, even when the plug for hot pipe making receives an external force in a circumferential direction such as torsion from a round billet, a joint portion between the plug pieces is not easily damaged.

(3) In the plug for hot pipe making according to (1) or (2), the connection member may be attached to at least one of an outer circumferential surface of the column-shaped portion and an inner circumferential surface of the joining hole.

According to this configuration, since the connection member is disposed at a portion which does not easily obtain a high temperature from the round billet during the hot pipe making, the plug pieces can be rigidly connected to each other.

(4) In the plug for hot pipe making according to (3), when the connection member is attached to the outer circumferential surface of the column-shaped portion, the joining hole may be formed in a ferromagnetic body which is at least a portion of the plug piece, and when the connection member is attached to the inner circumferential surface of the joining hole, at least the column-shaped portion of the plug piece may be formed by a ferromagnetic body.

According to this configuration, the plug pieces can be further rigidly connected to each other.

(5) In the plug for hot pipe making according to (4), one or more connection members may be disposed around an axis of the plug for hot pipe making in at least one of the outer circumferential surface of the column-shaped portion and the inner circumferential surface of the joining hole.

According to this configuration, the plug pieces can be further rigidly connected to each other.

(6) In the plug for hot pipe making according to (4) or (5), when the connection member is attached to the outer circumferential surface of the column-shaped portion, the connection member may be attached at a position away from an end of the column-shaped portion, and when the connection member is attached to the inner circumferential surface of the joining hole, the connection member may be attached at a position away from an opening end of the joining hole.

During the hot pipe making (during piercing-rolling by a piercing machine or during drawing-rolling by an elongator), the plug for the hot pipe making easily receives an external force in the axial direction of the plug from the round billet. According to the configuration of (6), since the connection member does not easily come into contact with the bottom surface of the joining hole, the connection member is not easily damaged.

(7) In the plug for hot pipe making according to any one of (3) to (6), a groove may be formed on at least one of the outer circumferential surface of the column-shaped portion and the inner circumferential surface of the joining hole, and the connection member may be fitted to the groove so that a gap is generated between a surface of the connection member and an opening surface of the groove.

According to this configuration, since the connection member does not protrude from the groove to the outside, during the joining and the heat pipe making, the connection member is not easily damaged.

(8) In the plug for hot pipe making according to (1) or (2), the connection member may be attached to at least one of an end surface of the column-shaped portion and a bottom surface of the joining hole.

According to this configuration, since the connection member is disposed at a portion which does not easily obtain a high temperature from the round billet during the hot pipe making, the plug pieces can be rigidly connected to each other.

(9) In the plug for hot pipe making according to (8), when the connection member is attached to the end surface of the column-shaped portion, the joining hole may be formed in a ferromagnetic body which is at least a portion of the plug piece, and when the connection member is attached to the bottom surface of the joining hole, at least the column-shaped portion of the plug piece may be formed by a ferromagnetic body.

According to this configuration, the plug pieces can be further rigidly connected to each other.

(10) In the plug for hot pipe making according to (9), a mounting hole may be formed on at least one of the end surface of the column-shaped portion and the bottom surface of the joining hole, and the connection member may be inserted into the mounting hole so that a gap is generated between a surface of the connection member and an opening surface of the mounting hole.

According to this configuration, since the connection member does not protrude from the mounting hole to the outside, during the joining and the heat pipe making, the connection member is not easily damaged.

Effects of the Invention

According to the aspects, it is possible to provide a plug for hot pipe making in which a partial exchange is easily performed and maintenance becomes easier.

EMBODIMENTS OF THE INVENTION

Figure 1:
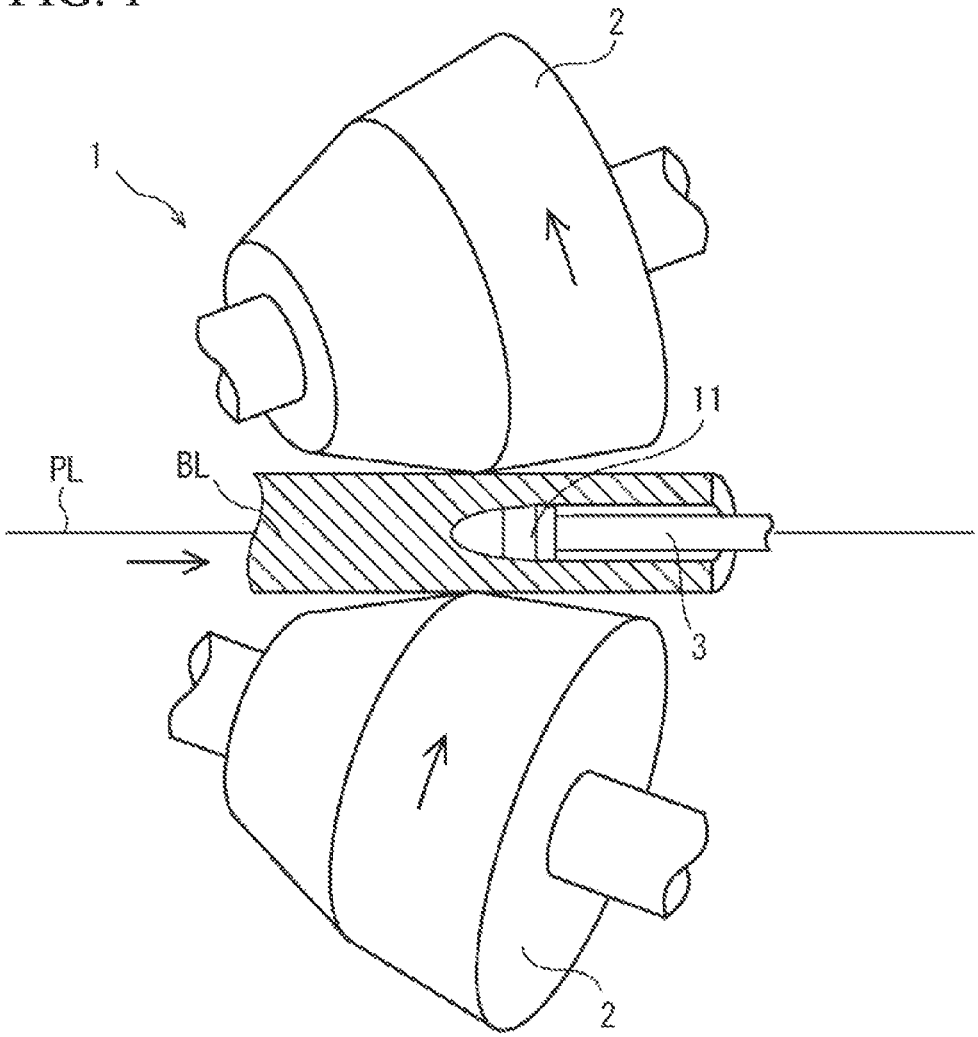
FIG. 1 is a schematic view showing a configuration of a piercing machine according to a first embodiment of the present invention.

Hereinafter, embodiments of the present invention will be described in detail with reference to the drawings. The same reference numerals are assigned to the same portions or the corresponding portions in the drawings, and descriptions thereof are omitted.

First Embodiment

Configuration of Piercing Machine

A plug for hot pipe making (hereinafter, referred to as a plug) according to a first embodiment is used in a piercing machine or an elongator. In descriptions below, the plug will be described while the plug is used in the piercing machine, for example. However, the plug used in the elongator also is similar to that of the piercing machine. FIG. 1 is an overall configuration view of the piercing machine 1. As shown in FIG. 1, the piercing machine 1 includes a pair of inclined rolls 2, a plug 11, and a mandrel 3.

The pair of inclined rolls 2 is disposed around a pass line PL. The inclined rolls 2 roll a round billet BL while rotating the round billet in the circumferential direction. The inclined rolls 2 may be a cone type or a barrel type.

The plug 11 is disposed on the pass line PL between the pair of inclined rolls 2. The mandrel 3 has a rod shape and is disposed on the pass line PL. The plug 11 is attached to a tip of the mandrel 3. The mandrel 3 fixes the plug 11 on the pass line PL.

When the round billet BL is piercing-rolled by the piercing machine 1, the plug 11 is pushed into a center of a front end surface (that is, an end surface opposing the plug 11) of the round billet BL, pierces the round billet BL, and forms a hollow pipe stock BL.

[Configuration of Plug 11]

A cross-sectional shape of an outer circumferential surface of the plug 11 is a circle, and an outer diameter of a rear end of the plug 11 is larger than that of a tip of the plug 11. For example, as shown in FIG. 1, the plug 11 has a shell shape.

Figure 2:
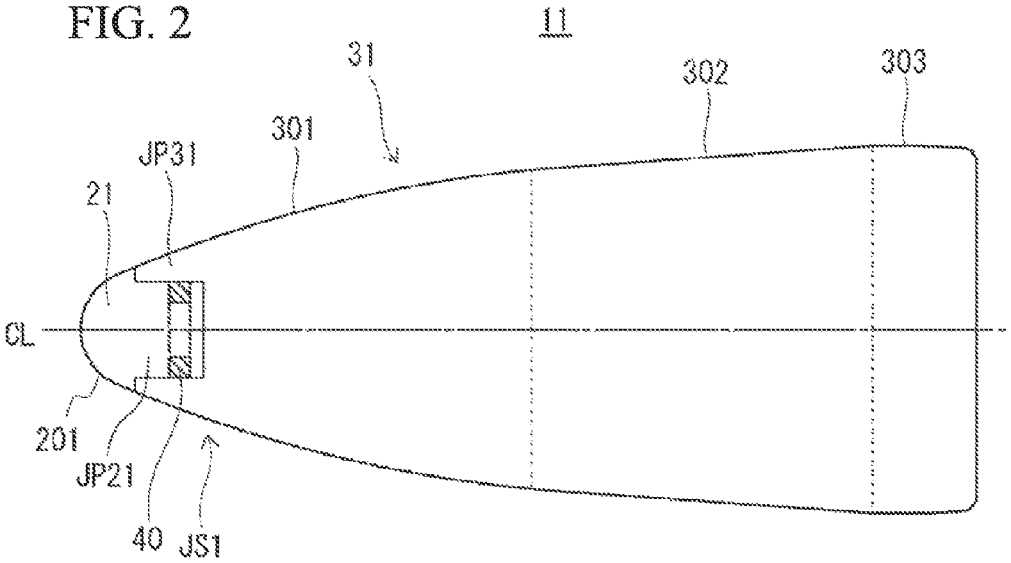
FIG. 2 is a longitudinal cross-sectional view of a plug shown in FIG. 1.

FIG. 2 is a longitudinal cross-sectional view of the plug 11. In addition, the longitudinal cross-sectional view means a cross-section including a center axis CL of the plug 11.

As shown in FIG. 2, the plug 11 includes a head member 21 and a plug main body 31 in this order from the tip. The head member 21 and the plug main body 31 are plug pieces which are attachable to and detachable from each other. The plug 11 is configured by connection between the plug pieces (that is, in the first embodiment, connection between the head member 21 and the plug main body 31).

Figure 3:
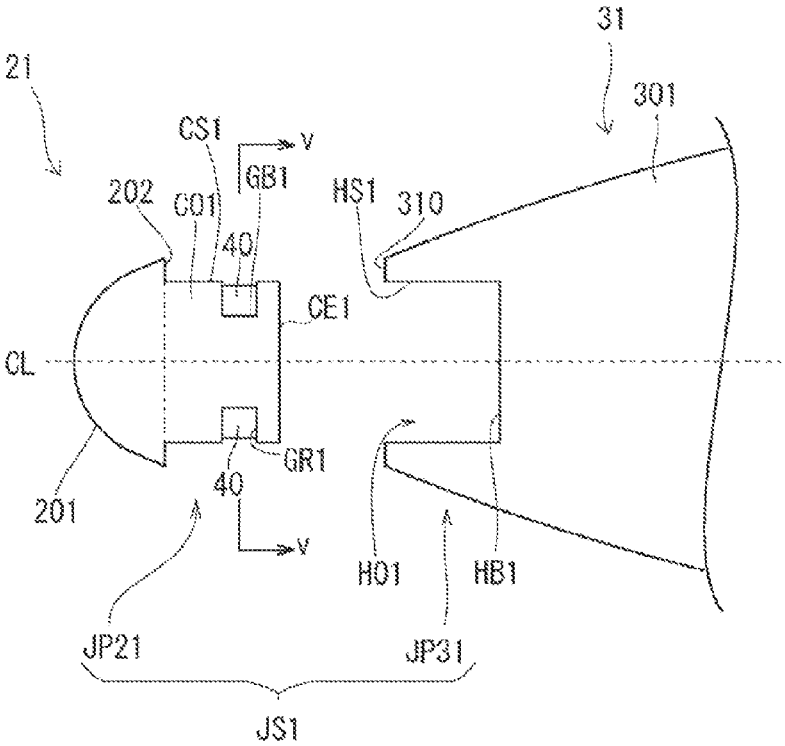
FIG. 3 is a longitudinal cross-sectional view in the vicinity of a joint structure in FIG. 2.

The head member 21 is pushed into the round billet BL during the piercing-rolling, and forms a hole in a center axis direction of the round billet BL. The head member 21 includes a tip surface 201. A longitudinal sectional shape of the tip surface 201 is a convex bow shape. As shown in FIG. 3, the head member 21 is attachable to and detachable from the plug main body 31.

The plug main body 31 provides the round billet BL (hereinafter, also may be referred to as a hollow pipe stock BL) having a hole formed by the head member 21 with desired dimensions (outer diameter and thickness). Specifically, the plug main body 31 comes into contact with the hollow pipe stock BL and increases an inner diameter of the hollow pipe stock BL. In addition, the plug main body 31 interposes the hollow pipe stock BL between the plug main body 31 and the inclined rolls 2 to roll the hollow pipe stock BL, and makes the thickness of the hollow pipe stock BL be a desired thickness.

The plug main body 31 includes a rolling portion 301, a reeling portion 302, and a relief portion 303 in this order from the tip side of the plug 11.

The cross-sectional shapes (that is, the cross-sectional shape orthogonal to the center axis of the plug 11) of the rolling portion 301 and the reeling portion 302 are circles. The outer diameters of the rolling portion 301 and the reeling portion 302 gradually increase from the tip of the plug 11 toward the rear end. The rolling portion 301 increases the inner diameter of the hollow pipe stock BL during the piercing-rolling. For example, the longitudinal sectional shape of the outer surface of the rolling portion 301 is an arc which has one or a plurality of curvatures. The reeling portion 302 makes the thickness of the hollow pipe stock BL be a desired thickness. For example, the outer surface shape of the reeling portion 302 is a tapered shape.

The relief portion 303 prevents occurrence of scratches on the inner surface of the hollow pipe stock BL. The outer diameter of the relief portion 303 is constant, or gradually decreases from the tip of the plug 11 toward the rear end. Accordingly, the relief portion 303 does not easily come into contact with the inner surface of the hollow pipe stock BL during the piercing-rolling, and can prevent occurrence of scratches on the inner surface of the hollow pipe stock BL.

In addition, the plug main body 31 may not have the relief portion 303. Moreover, the outer surface shapes of the rolling portion 301 and the reeling portion 302 are not limited to the above-described shape.

A material of the head member 21 may be the same as the plug main body 31, or may be different from the plug main body. For example, the material of the head member 21 may be a material different from the plug main body 31, and at least one of wear resistance, seize resistance, and erosion resistance of the head member may be better than with the material of the plug main body 31.

As shown in FIG. 2, the plug 11 includes a joint structure JS1 at a joint portion between the head member 21 and the plug main body 31. The joint structure JS1 includes a connection member 40. The connection member 40 has a magnetic force and detachably connects the head member 21 to the front end of the plug main body 31 by the magnetic force. Hereinafter, the joint structure JS1 will be described in detail.

[Joint Structure JS1]

As shown in FIG. 3, the head member 21 includes a joint portion JP21 on the rear end. Meanwhile, the plug main body 31 includes a joint portion JP31 on the front end. The joint portion JP21 is joined to the joint portion JP31. The joint portions JP21 and JP31 configure the joint structure JS1.

One of the joint portions JP21 and JP31 includes a column-shaped portion CO1, and the other includes a joining hole HO1. In FIG. 3, the joint portion JP21 (that is, the head member 21) includes the column-shaped portion CO1, and the joint portion JP31 (that is, the plug main body 31) includes the joining hole HO1. That is, in the first embodiment, the head member 21 includes the column-shaped portion CO1, and the plug main body 31 includes the joining hole HO1 into which the column-shaped portion CO1 is inserted.

Figure 4:
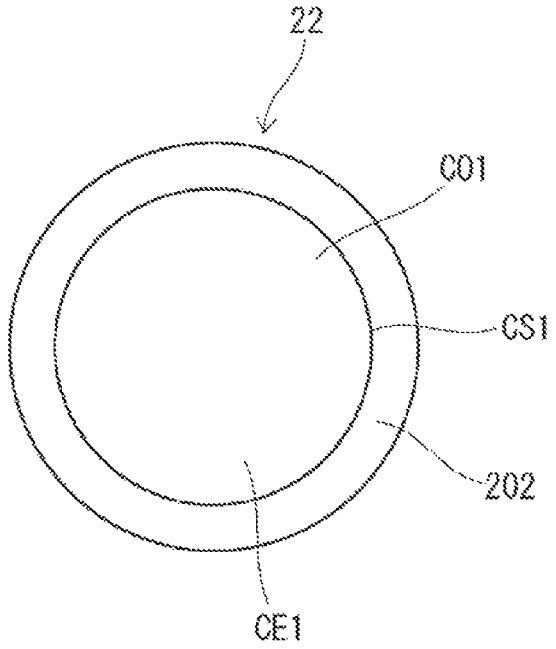
FIG. 4 is a rear view of a head member in FIG. 3.

The column-shaped portion CO1 extends in the direction of the axis CL of the plug 11 from a rear end surface 202 of the head member 21. In the first embodiment, as shown in FIGS. 3 and 4, the cross-sectional shape of the column-shaped portion CO1 is a circle. The column-shaped portion CO1 includes an outer circumferential surface CS1 and an end surface CE1 as a surface.

Meanwhile, as shown in FIG. 3, the joining hole HO1 is formed on a front end surface 310 of the plug main body 31, and extends in the direction of the axis CL. The cross-sectional shape of the joining hole HO1 is a circle. The joining hole HO1 includes an inner circumferential surface HS1 and a bottom surface HB1 as a surface.

The column-shaped portion CO1 is inserted into the joining hole HO1. When the column-shaped portion CO1 is inserted into the joining hole HO1, the outer circumferential surface CS1 opposes the inner circumferential surface HS1, and the end surface CE1 opposes the bottom surface HB1. The connection member 40 is attached to the outer circumferential surface CS1 of the column-shaped portion CO1, and connects the column-shaped portion CO1 to the joining hole HO1 by the magnetic force. Accordingly, the head member 21 and the plug main body 31 are detachably connected to each other.

The connection member 40 is a magnet, and more specifically, is a permanent magnet. Meanwhile, a material of at least the joint portion JP31 in the plug main body 31 is a magnetic body, and more specifically, is a ferromagnetic body.

In this way, the plug 11 can detachably connect the head member 21 to the plug main body 31 using the magnetic force of the connection member 40 included in the joint structure JS1. Like the related art, when the head member and the plug main body are mechanically connected to each other by a mounting member such as a screw, the joint structure between the head member and the plug main body becomes complicated, and strength of the joint structure is easily decreased. Accordingly, the joint structure may be damaged during the piercing-rolling.

On the other hand, in the plug 11, the head member 21 is connected to the plug main body 31 by the magnetic force using the connection member 40. Accordingly, the joint structure JS1 has a simple structure (column-shaped portion CO1 and joining hole HO1), and thus, the plug is not easily damaged during the piercing-rolling.

Moreover, since the head member 21 is connected to the plug main body 31 by the magnetic force in the joint structure JS1 (also since the cross-sectional shapes of the column-shaped portion CO1 and the joining hole HO1 are circular shapes), the head member 21 can freely rotate around the axis CL during the piercing-rolling. Like the related art, in the case where the head member is fixed to the plug main body by shrinkage fitting, a bonding agent, and a mounting member such as a screw, when the head member receives an external force (torsion) in the circumferential direction from the round billet, the head member cannot rotate. Accordingly, the joint structure is easily damaged. On the other hand, in the case of the joint structure JS1, the head member 21 receiving the external force in the circumferential direction freely rotates in the circumferential direction. Accordingly, the damage to the joint structure JS1 can be prevented.

The connection member 40 having the magnetic force is attached to the head member 21. Accordingly, the material of the head member 21 may not be a ferromagnetic body. Therefore, a nonmagnetic high-strength heat-resistant material including Nb base alloy or Mo base alloy may be used as the material of the head member 21. In addition, a nonmagnetic material such as a ceramic may be also used as the material of the head member 21.

The tip surface 201 of the plug 11 and the outer layer portion in the vicinity thereof obtain a high temperature from the round billet BL, and the temperature becomes a high temperature of approximately 1000° C. during the piercing-rolling. However, in other regions except for the outer layer portion, the temperature is less than or equal to 300° C. even during the piercing-rolling. Accordingly, the connection member 40 has the magnetic force even during the piercing-rolling, and ferromagnetism of the plug main body 31 is maintained.

Compared to the joining method (such as shrinkage fitting and screw fixing) of the related art, since the head member 21 is connected to the plug main body 31 by the magnetic force of the connection member 40, the head member 21 can be easily attached to and detached from the plug main body 31. As described above, compared to the plug main body 31, during the piercing-rolling, a high heat quantity and a high external force are applied to the head member 21, and the head member is easily eroded. However, in the first embodiment, the head member 21 can be easily removed from the plug main body 31, and a new head member 21 can be easily connected to the plug main body 31 in a short amount of time. That is, the exchange of the head member 21 or the plug main body 31 is easily performed. In this way, in the plug 11 according to the first embodiment, a partial exchange is easily performed, and the maintenance becomes easier. As a result, a life span of the plug 11 can be lengthened.

Figure 5:
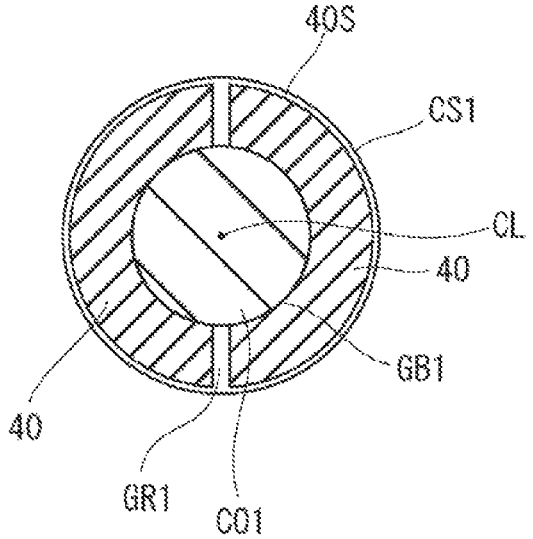
FIG. 5 is a cross-sectional view taken along line V-V in FIG. 3.

FIG. 5 is a cross-sectional view taken along line V-V of FIG. 3. As shown in FIGS. 3 and 5, a groove GR1 is formed on the outer circumferential surface CS1 of the column-shaped portion CO1. The groove GR1 extends around the axis CL and includes a groove bottom GB1.

In FIG. 5, a plurality of connection members 40 are attached to the groove GR1. Accordingly, the plurality of connection members 40 are disposed around the axis CL. As a result, an area which is adsorbed by the magnetic force is increased, and thus, the connection force is increased. The connection member 40 is fixed to the groove GR1 by a well-known method. For example, the connection member 40 may be fixed to the groove GR1 by shrinkage fitting, or may be fixed to the groove GR1 using a bonding agent. The connection member 40 may be fixed to the groove GR1 using a fixing member such as a screw or a bolt. Moreover, one or more connection members 40 may be disposed on the groove GR1.

As shown in FIG. 5, preferably, a surface 40S of the connection member 40 inserted into and attached to the groove GR1 is disposed to be closer to the groove bottom GB1 side than the outer circumferential surface CS1 of the column-shaped portion CO1. In other words, preferably, the connection member 40 is fitted to the groove GR1 so that a gap is generated between the surface 40S of the connection member 40 and an opening surface (a surface which is flush with the outer circumferential surface CS1 of the column-shaped portion CO1) of the groove GR1. In this configuration, the connection member 40 does not protrude from the outer circumferential surface CS1 to the outside. Accordingly, when the head member 21 is attached to the plug main body 31, the connection member 40 does not easily come into contact with the inner circumferential surface HS1 of the joining hole HO1. As a result, during the joining or during piercing-rolling, cracks or damage to the connection member 40 can be prevented.

As shown in FIG. 3, preferably, the connection member 40 is attached at a position away from the rear end (rear end surface CE1) of the column-shaped portion CO1. As a result, during the joining, the connection member 40 does not come into contact with the bottom surface HB1 of the joining hole HO1, and instead, the rear end surface CE1 comes into contact with the bottom surface HB1.

As described above, during the piercing-rolling, the plug 11 is pushed into the round billet BL. At this time, the plug 11 receives a strong external force in the direction of the axis CL. The head member 21 is pressed to the plug main body 31 by the external force.

If the connection member 40 is attached to the rear end of the outer circumferential surface CS1 and the connection member 40 comes into contact with the bottom surface HB1 during the joining, the connection member 40 is pressed to the bottom surface HB1 by the external force. As a result, the connection member 40 is easily damaged.

As shown in FIG. 3, if the connection member 40 is attached at a position away from the rear end of the outer circumferential surface CS1, the external force applied in the direction of the axis CL during the piercing-rolling is applied to the rear end surface CE1 and is not easily applied to the connection member 40. As a result, the connection member 40 is not easily damaged.

Figure 6:
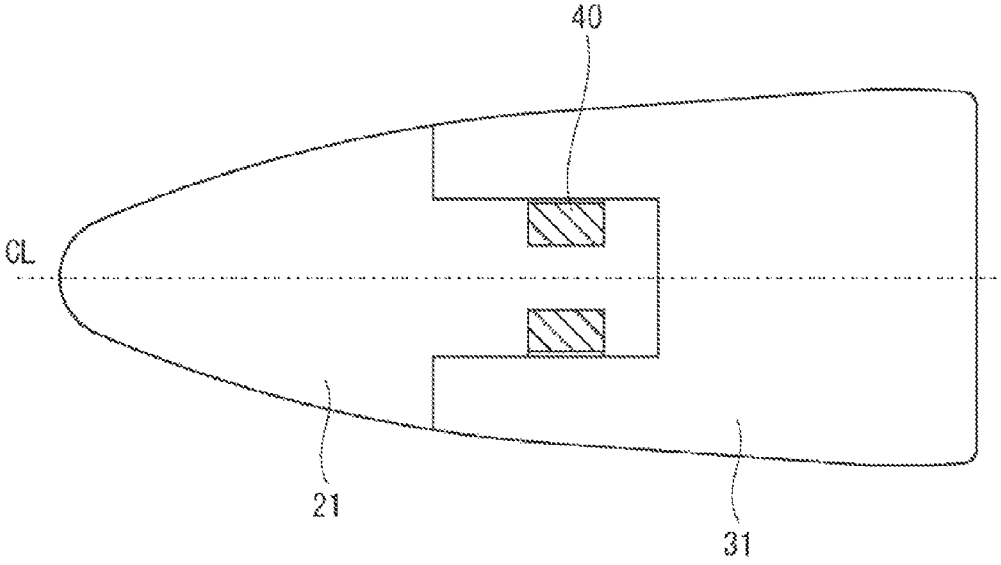
FIG. 6 is a longitudinal cross-sectional view of a plug different from that of FIG. 2.

In the first embodiment, a size of the head member 21 is not particularly limited. For example, as shown in FIG. 6, the head member 21 may have a length equal to or more than ⅓ of that of the plug 11 from the tip. At this time, the surface of the head member 21 may include not only the rolling portion but also the reeling portion.

Figure 7:
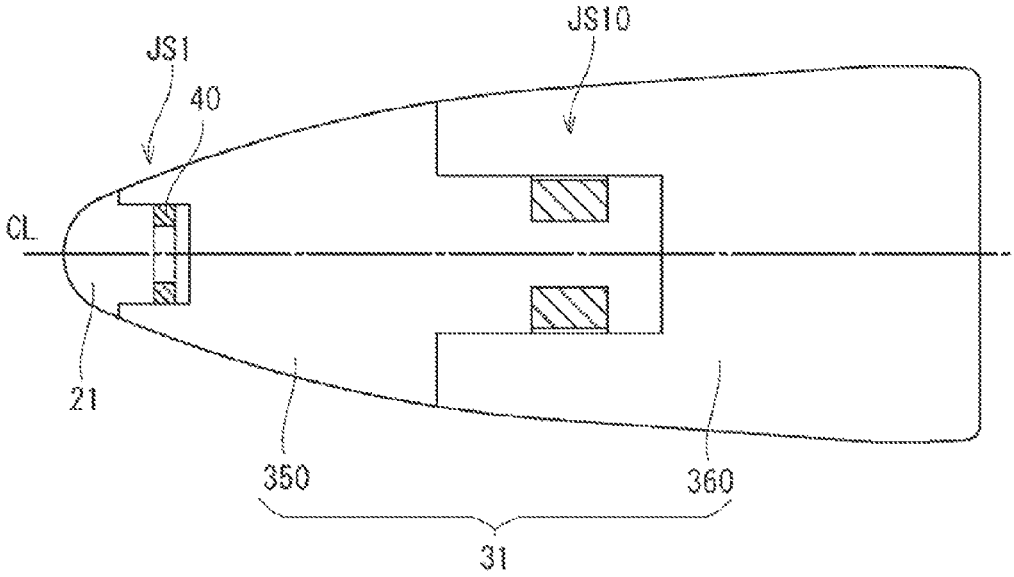
FIG. 7 is a longitudinal cross-sectional view of a plug different from those of FIGS. 2 and 3.

In addition, as shown in FIG. 7, the plug main body 31 can be divided into a front portion 350 and a rear portion 360, and the front portion 350 and the rear portion 360 may include a joint structure JS10 having a configuration similar to the joint structure JS1. That is, a plurality of joint structures JS1 may be provided on the plug 11. Similar to the joint structure JS1, the joint structure JS10 includes the column-shaped portion CO1 and the joining hole HO1, and includes the connection member 40. In this case, the front portion 350 and the rear portion 360 of the plug main body 31, and the tip material 21 are plug pieces which can be attached to and detached from each other. That is, the number of the plug pieces configuring the plug 11 may be two as shown in FIG. 2 and may be three as shown in FIG. 7. Moreover, the number of the plug pieces configuring the plug 11 may be four or more.

Second Embodiment

In the joint structure JS1 of the above-described first embodiment, the connection member 40 is attached to the outer circumferential surface CS1 of the column-shaped portion CO1. However, the plug may include a joint structure having a configuration other than the joint structure JS1.

Figure 8:
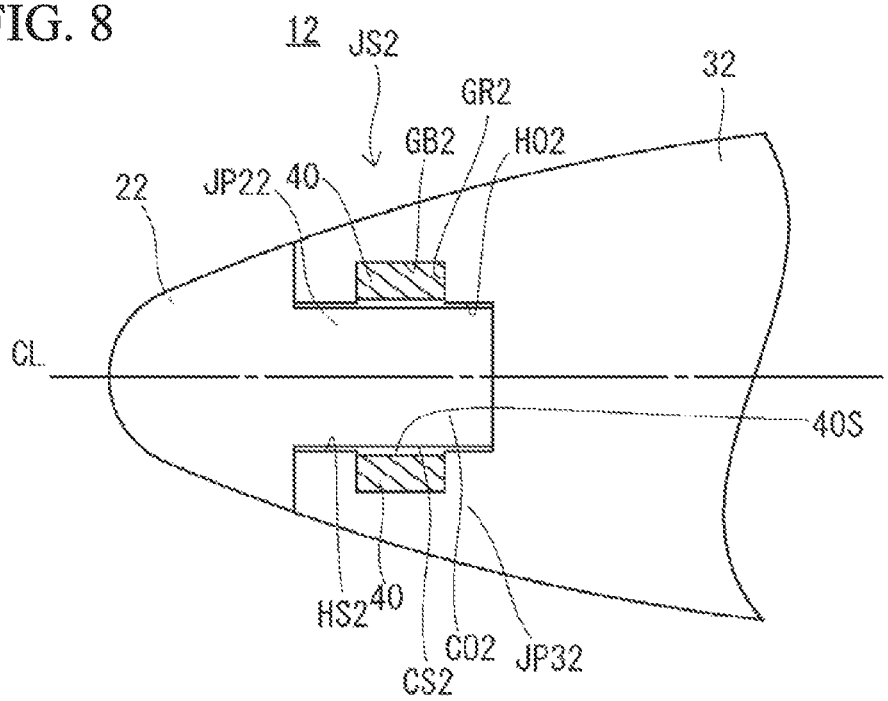
FIG. 8 is a longitudinal cross-sectional view in the vicinity of a joint structure of a plug according to a second embodiment of the present invention.

FIG. 8 is a longitudinal cross-sectional view of a joint structure of a plug 12 according to a second embodiment. As shown in FIG. 8, the plug 12 includes a head member 22 and a plug main body 32. Compared to the plug 11, the plug 12 includes a new joint structure JS2 instead of the joint structure JS1. Other configurations of the plug 12 are the same as the plug 11.

Specifically, the head member 22 includes a joint portion JP22 instead of the joint portion JP21. Other configurations of the head member 22 are the same as the head member 21. The joint portion JP22 includes a column-shaped portion CO2. Compared to the column-shaped portion CO1, in the column-shaped portion CO2, a groove is not formed on an outer circumferential surface CS2, and the connection member 40 is not attached to the column-shaped portion. Other configurations of the column-shaped portion CO2 are the same as the column-shaped portion CO1.

The plug main body 32 includes a joint portion JP32 instead of the joint portion JP31. Other configurations of the plug main body 32 are the same as the plug main body 31. The joint portion JP32 includes a joining hole HO2. Compared to the joining hole HO1, in the joining hole HO2, the groove GR2 is formed on an inner circumferential surface HS2, and the connection member 40 is attached to the groove GR2. Other configurations of the joining hole HO2 are the same as the joining hole HO1.

That is, in the joint structure JS2, a plurality of (or the number may be one or more) connection members 40 are attached not to the outer circumferential surface CS2 of the column-shaped portion CO2 but to the inner circumferential surface HS2 of the joining hole HO2. Accordingly, the material of the joint portion JP21 to which the connection member 40 is not attached, that is, the material of at least the column-shaped portion CO2 of the head member 22 is a ferromagnetic body.

Similar to the joint structure JS1, the joint structure JS2 having the above-described configuration also can connect the head member 22 to the plug main body 32 by the magnetic force.

The groove GR2 extends around the axis CL. Accordingly, the plurality of connection members 40 are disposed around the axis CL. As a result, the area which is adsorbed by the magnetic force is increased, and thus, the connection force is increased. Similar to the first embodiment, in the second embodiment, preferably, the surface 40S of the connection member 40 is disposed to be closer to the groove bottom GB2 side than the inner circumferential surface HS2. In other words, preferably, the connection member 40 is fitted to the groove GR2 so that a gap is generated between the surface 40S of the connection member 40 and an opening surface (a surface which is flush with the inner circumferential surface HS2 of the joining hole HO2) of the groove GR2.

Third Embodiment

Figure 9:
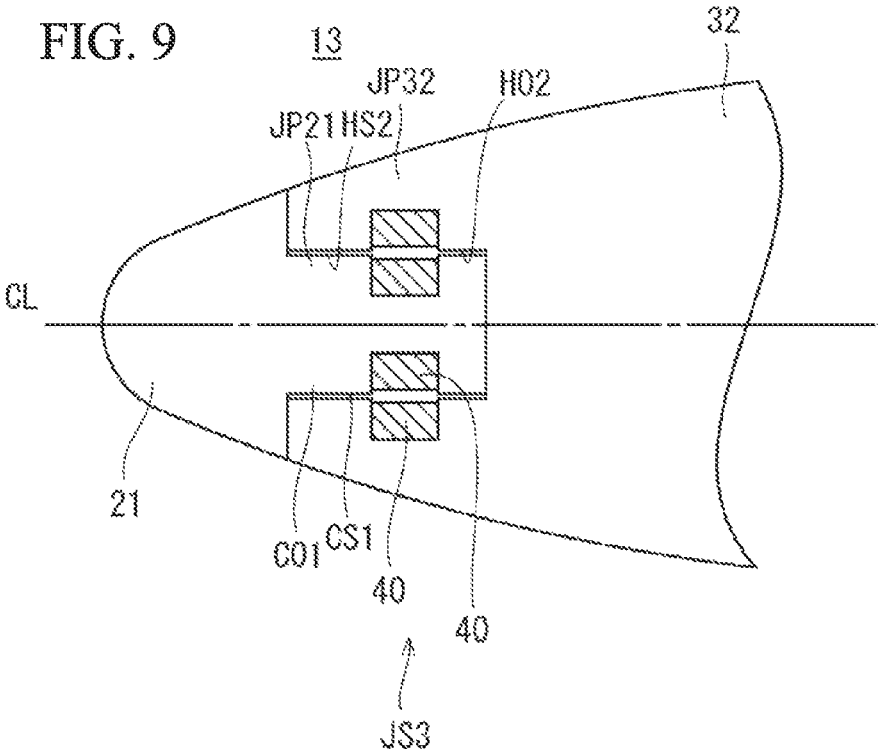
FIG. 9 is a longitudinal cross-sectional view in the vicinity of a joint structure of a plug according to a third embodiment of the present invention.

FIG. 9 is a longitudinal cross-sectional view of a joint structure JS3 of a plug 13 according to a third embodiment. As shown in FIG. 9, the plug 13 includes the head member 21 and the plug main body 32. In this case, the joint structure JS3 is configured of the joint portion JP21 and the joint portion JP32. That is, in the joint structure JS3, the connection members 40 are attached to both the outer circumferential surface CS1 of the column-shaped portion CO1 and the inner circumferential surface HS2 of the joining hole HO2.

The connection member 40 of the outer circumferential surface CS1 and the connection member 40 of the inner circumferential surface HS2 are disposed to oppose each other, and thus, are disposed to be attracted to each other. Accordingly, the head member 21 is connected to the plug main body 32 by the magnetic force.

In the plug 13, as the materials of the joint portion JP21 of the head member 21 and the joint portion JP32 of the plug main body 32, a nonmagnetic material may be used.

Fourth Embodiment

In the first to third embodiments, the joint portions JP21 and JP22 of the head members 21 and 22 include the column-shaped portions CO1 and CO2, and the joint portions JP31 and JP32 of the plug main bodies 31 and 32 include the joining holes HO1 and HO2. However, even when the column-shaped portion CO is disposed on the plug main body and the joining hole HO is disposed on the head member, effects similar to the first to third embodiments can be obtained.

Figure 10:
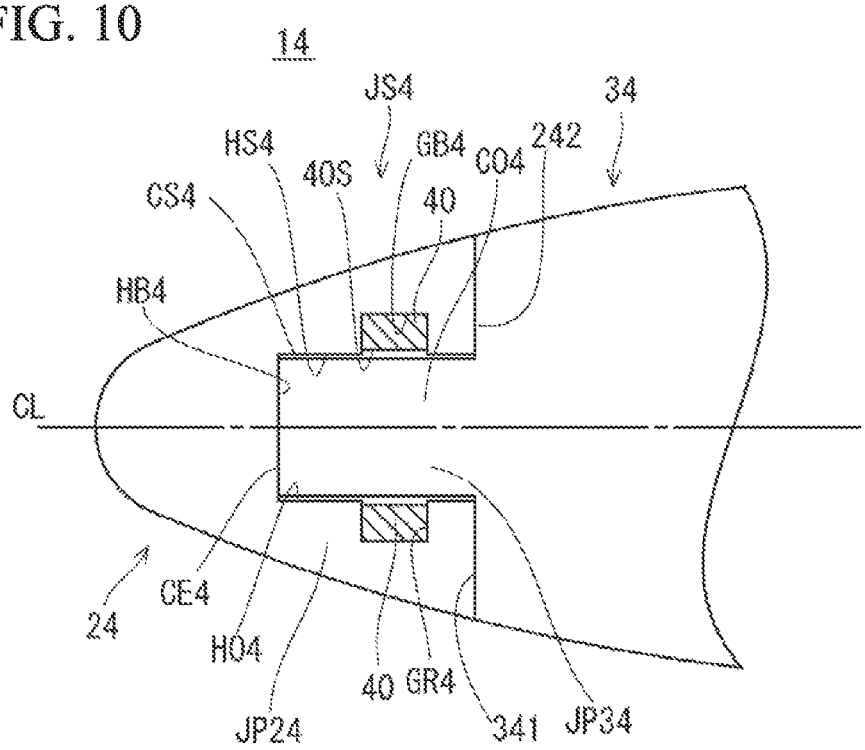
FIG. 10 is a longitudinal cross-sectional view in the vicinity of a joint structure of a plug according to a fourth embodiment of the present invention.

FIG. 10 is a longitudinal cross-sectional view of a joint structure JS4 of a plug 14 according to a fourth embodiment. As shown in FIG. 10, the plug 14 includes a head member 24 and a plug main body 34. Compared to the plug 11, the plug 14 includes a new joint structure JS4 instead of the joint structure JS1. Other configurations of the plug 14 are the same as the plug 11.

Specifically, the head member 24 includes a joint portion JP24 instead of the joint portion JP21. Other configurations of the head member 24 are the same as the head member 21. The joint portion JP24 includes a joining hole HO4. The joining hole HO4 extends in the direction of the axis CL from a rear end surface 242 of the head member 24, and includes an inner circumferential surface HS4 and a bottom surface HB4 as a surface.

Compared to the plug main body 31, the plug main body 34 includes a joint portion JP34 instead of the joint portion JP31. Other configurations of the plug main body 34 are the same as the plug main body 31. The joint portion JP34 includes a column-shaped portion CO4. The column-shaped portion CO4 extends in the direction of the axis CL from a front surface 341 of the plug main body 34, and includes an outer circumferential surface CS4 and a front end surface CE4 as a surface. During the joining, the column-shaped portion CO4 is inserted into the joining hole HO4.

A groove GR4 extending around the axis CL is formed on the inner circumferential surface HS4 of the joining hole HO4, and a plurality of connection members 40 are inserted into the groove GR4 and are attached to the groove.

In this way, even in the joint structure JS4 in which the joint portion JP24 of the head member 24 includes the joining hole HO4 and the joint portion JP34 of the plug main body 34 includes the column-shaped portion CO4, similar to other joint structures JS1 to JS3, the head member 24 can be connected to the plug main body 34 by the magnetic force of the connection member 40. In the fourth embodiment, the material of the plug main body 34 is a ferromagnetic body.

Also in the joint structure JS4, preferably, the surface 40S of the connection member 40 is disposed to be closer to the groove bottom GB4 side of the groove GR4 than the inner circumferential surface HS4. In other words, preferably, the connection member 40 is fitted to the groove GR4 so that a gap is generated between the surface 40S of the connection member 40 and an opening surface (a surface which is flush with the inner circumferential surface HS4 of the joining hole HO4) of the groove GR4.

Fifth Embodiment

Figure 11:
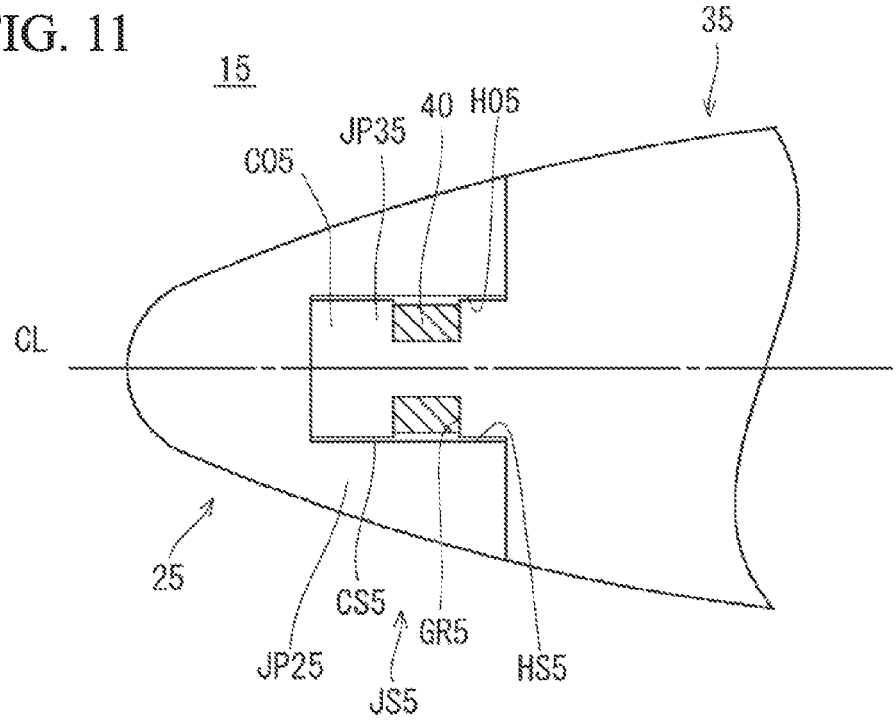
FIG. 11 is a longitudinal cross-sectional view in the vicinity of a joint structure of a plug according to a fifth embodiment of the present invention.

FIG. 11 is a longitudinal cross-sectional view of a joint structure JS5 of a plug 15 according to a fifth embodiment. As shown in FIG. 11, the plug 15 includes a head member 25 and a plug main body 35. Compared to the plug 14, the plug 15 includes a joint structure JS5 instead of the joint structure JS4.

Compared to the head member 24, the head member 25 includes a joint portion JP25 instead of the joint portion JP24. Other configurations of the head member 25 are the same as the head member 24. Compared to the plug main body 34, the plug main body 35 includes a joint portion JP35 instead of the joint portion JP34. Other configurations of the plug main body 35 are the same as the plug main body 34. The joint portion JP25 of the head member 25 includes a joining hole HO5, and the joint portion JP35 of the plug main body 35 includes a column-shaped portion CO5.

Compared to the plug 14, in the plug 15, the connection member 40 is attached not to the joining hole HO5 but to the column-shaped portion CO5. A groove GR5 extending around the axis CL is formed on the column-shaped portion CO5. The connection member 40 is inserted into the groove GR5 and is attached to the groove. In the fifth embodiment, the material of the head member 25 is a ferromagnetic body.

Sixth Embodiment

Similar to the third embodiment, in a sixth embodiment, the plug may include the head member 24 and the plug main body 35. In this case, the connection member 40 attached to the head member 24 and the connection member 40 attached to the plug main body 35 are disposed to oppose each other during the joining, and thus, are disposed to be attracted to each other.

As described in the first to sixth embodiments, one of the joint portion of the head member and the joint portion of the plug main body includes the column-shaped portion CO, and the other includes the joining hole HO. Moreover, the connection member 40 may be attached to at least one of the outer circumferential surface CS of the column-shaped portion CO and the inner circumferential surface HS of the joining hole HO. Moreover, the material of the other joint portion different from the joint portion to which the connection member 40 is attached may be a ferromagnetic body. According to the joint structure JS having the above-described configuration, the head member can be connected to the plug main body by the magnetic force of the connection member 40.

Seventh Embodiment

In the first to sixth embodiments, the connection member 40 is attached to at least one of the outer circumferential surface CS of the column-shaped portion CO and the inner circumferential surface HS of the joining hole HO. However, the connection member 40 may be attached to other portions.

Figure 12:
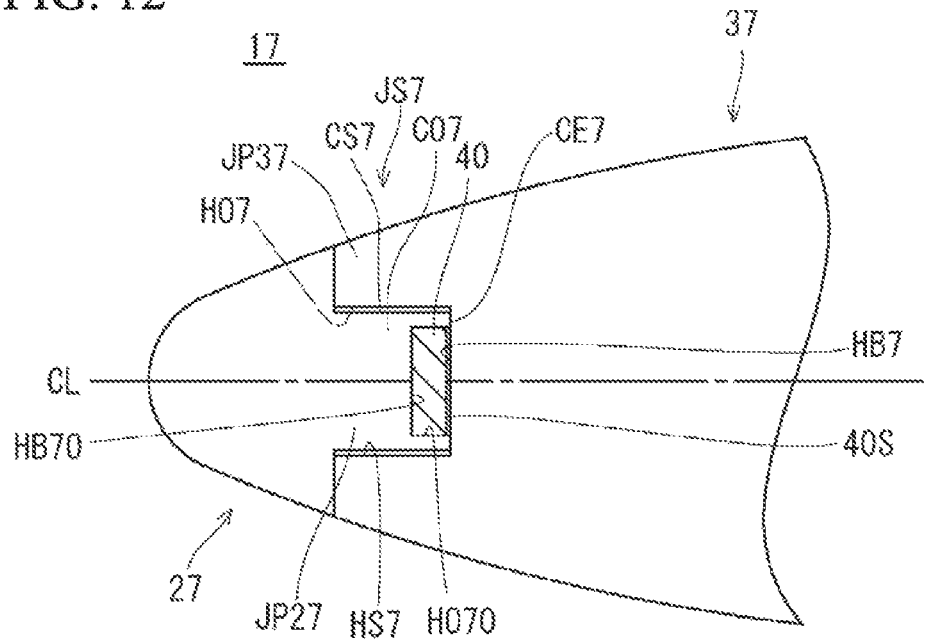
FIG. 12 is a longitudinal cross-sectional view in the vicinity of a joint structure of a plug according to a seventh embodiment of the present invention.

FIG. 12 is a longitudinal cross-sectional view of a joint structure JS7 of a plug 17 according to a seventh embodiment. As shown in FIG. 12, the plug 17 includes a head member 27 and a plug main body 37. Compared to the plug 11, the plug 17 includes a new joint structure JS7 instead of the joint structure JS1. Other configurations of the plug 17 are the same as the plug 11.

The head member 27 includes a joint portion JP27 instead of the joint portion JP21. Other configurations of the head member 27 are the same as the head member 21. The joint portion JP27 includes a column-shaped portion CO7.

The plug main body 37 includes a joint portion JP37 instead of the joint portion JP31, and other configurations of the plug main body 37 are the same as the plug main body 31. The joint portion JP37 includes a joining hole HO7. The column-shaped portion CO7 includes an outer circumferential surface CS7 and a rear end surface CE7 as a surface. The joining hole HO7 includes an inner circumferential surface HS7 and a bottom surface HB7 as a surface. The column-shaped portion CO7 is inserted into the joining hole HO7. At this time, a rear end surface CE7 of the column-shaped portion CO7 opposes a bottom surface HB7 of the joining hole HO7, and preferably, comes into contact with the bottom surface HB7.

The connection member 40 is attached to the rear end surface CE7 of the column-shaped portion CO7. In this case, for example, the connection member 40 is formed in a plate shape. A plurality of connection members 40 may be attached to the joining hole HO7.

A mounting hole HO70 including a bottom surface HB70 is formed on the rear end surface CE7, and the connection member 40 is disposed in the mounting hole HO70, and is attached by shrinkage fitting or a bonding agent.

That is, in the plug 17 according to the seventh embodiment, the connection member 40 is attached to the rear end surface CE7 of the column-shaped portion CO7. In this case, the material of the joint portion JP37 of the plug main body 37 is a ferromagnetic body.

Similar to other joint structures JS, the joint structure JS7 having the above-described configuration can also connect the head member 27 to the plug main body 37 by the magnetic force of the connection member 40.

Preferably, the surface 40S (the surface opposing the bottom surface HB7) of the connection member 40 is disposed to be closer to the bottom surface HB70 side than the rear end surface CE7. In other words, preferably, the connection member 40 is inserted into the mounting hole HO70 so that a gap is generated between the surface 40S of the connection member 40 and an opening surface (a surface which is flush with the rear end surface CE7 of the column-shaped portion CO7) of the mounting hole HO70.

As described above, the plug 17 receives a strong external force in the direction of the axis CL during the piercing-rolling. Accordingly, the rear end surface CE7 is strongly pressed while coming into contact with the bottom surface HB7. If the connection member 40 protrudes from the rear end surface CE7 to the outside, since the connection member 40 comes into contact with the bottom surface HB7, the connection member 40 may be damaged during the piercing-rolling. If the surface 40S of the connection member 40 is disposed to be closer to the bottom surface HB70 side than the rear end surface CE7, the damage of the connection member 40 can be suppressed.

Figure 13:
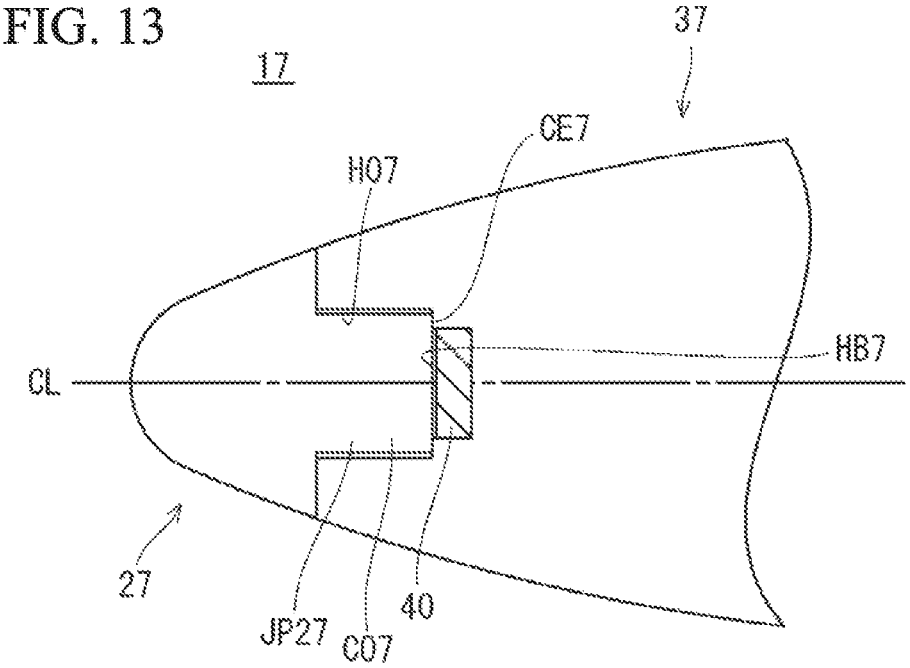
FIG. 13 is a longitudinal cross-sectional view in the vicinity of a joint structure of a plug different from that of FIG. 12.

In addition, as shown in FIG. 13, similar to the first to sixth embodiments, the connection member 40 may not be attached to the rear end surface CE7 and may be attached to the bottom surface HB7 of the joining hole HO7. In this case, a mounting hole for inserting the connection member 40 into the bottom surface HB7 is also formed on the bottom surface. In this case, the material of the joint portion JP27 (column-shaped portion CO7) of the head member 27 is a ferromagnetic body.

Moreover, the connection members 40 may be attached to both the rear end surface CE7 of the column-shaped portion CO7 and the bottom surface HB7 of the joining hole HO7. In this case, preferably, the connection member 40 of the rear end surface CE7 and the connection member 40 of the bottom surface HB7 are disposed to oppose each other, and are disposed to be attracted to each other.

Figure 14:
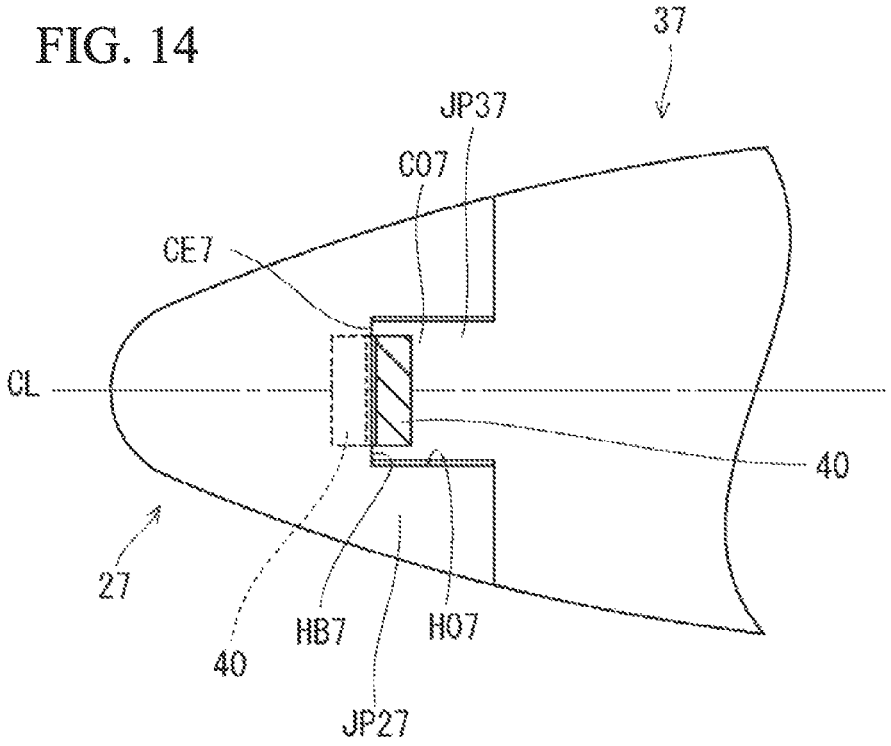
FIG. 14 is a longitudinal cross-sectional view in the vicinity of a joint structure of a plug different from those of FIGS. 12 and 13.

Moreover, as shown in FIG. 14, the joint portion JP27 of the head member 27 may include the joining hole HO7 instead of the column-shaped portion CO7, and the joint portion JP37 of the plug main body 37 may include the column-shaped portion CO7 instead of the joining hole HO7. In addition, the connection member 40 is attached to at least one of a front end surface CE7 of the column-shaped portion CO7 and a bottom surface HB7 of the joining hole HO7.

That is, one of the joint portion of the head member and the joint portion of the plug main body may include the column-shaped portion CO, the other may include the joining hole HO, and the connection member 40 may be attached to at least one of the end surface CE of the column-shaped portion CO and the bottom surface HB of the joining hole HO. Moreover, the material of the joint portion different from the joint portion to which the connection member 40 is attached may be a ferromagnetic body.

In the first to seventh embodiments, the cross-sectional shape of the column-shaped portion CO is a circle. However, the cross-sectional shape of the column-shaped portion CO does not have to be a circle but, for example, may be a polygon or an ellipse. In this case, even though the head member may not be freely rotated, similar to the first to seventh embodiments, the head member is detachably connected to the plug main body.

Moreover, the column-shaped portion CO may include a tapered shape in which the width decreases toward the end surface CE. In this case, preferably, the joining hole HO includes a tapered shape in which the width decreases toward the bottom surface HB. Although this shape is provided, the head member can be connected to the plug main body by the connection member 40.

In the first to seventh embodiments, the joint structure JS includes the plurality of connection members 40. However, the joint structure JS may include only one connection member 40. Moreover, in the first to seventh embodiments, a plurality of the plug pieces configuring the plug may be provided.

In the first to seventh embodiments, the plug of the present invention is exemplified by the plug used in the piercing machine. However, the plug of the present invention may be applied to a plug for an elongator. That is, the plug of the present invention can be widely applied to a plug which is used for hot pipe making.

EXAMPLES

A plurality of kinds of plugs were prepared, and a round billet was piercing-rolled using each plug. Moreover, the number of times of rolling (hereinafter, referred to as the number of passes) until each plug was eroded was investigated.

[Test Method]

Plugs having the structures shown in Table 1 were prepared.

TABLE 1

| | | Material | | The Number of Passes |
|---|---|---|---|---|
| Mark | Plug Structure | Head Member | Plug Main Body | (Times) |
| 1 | Integral Type | Cr—Ni Based Low Alloy | | 2 |
| 2 | FIG. 2 | Cr—Ni Based Low Alloy | Cr—Ni Based Low Alloy | 10 |
| 3 | FIG. 2 | Nb based Alloy | Cr—Ni Based Low Alloy | 10 |

As shown in Table 1, although the plug of Mark 1 had a shape of the outer circumferential surface which was the same as FIG. 2, the head member and the plug main body were integrally manufactured and could not be separated from each other, which was a configuration of the related art. The material of the plug of Mark 1 was Cr—Ni base low alloy.

On the other hand, the plugs of Mark 2 and Mark 3 had a configuration which was the same as FIG. 2, and the head member and the plug main body could be separated from each other. As the head member and the plug main body of Mark 2 and the plug main body of Mark 3, the Cr—Ni base low alloy having a chemical composition which was the same as Mark 1 was used. Meanwhile, as the head member of Mark 3, Nb base alloy having better wear resistance, seize resistance, and erosion resistance than the Cr—Ni base low alloy was used.

The round billet was piercing-rolled using the plugs of Marks 1 to 3. The material of the round billet was a so-called 13 Cr base alloy in which 13 mass % Cr was contained. The diameter of the round billet was 70 mm and the length was 400 mm. The round billet was heated to 1220° C., was piercing-rolled, and a hollow pipe stock having an outer diameter of 74 mm, a thickness of 8.5 mm, and a length of 900 mm was manufactured.

During the piercing-rolling, in the plug of Mark 2, the head member was exchanged with a new head member every time two round billets were piercing-rolled (that is, every two passes).

Under the above-described piercing-rolling conditions, the piercing-rolling was continued until the plug main body of the plug of each Mark was eroded. Whether or not erosion of the plug occurred was visually observed every time one round billet was piercing-rolled. When the erosion was observed after piercing-rolling was performed n times, the number of passes was defined as n−1 times.

[Test Results]

The test results are shown in Table 1. As shown in Table 1, the number of passes in the plugs of Marks 2 and 3 was 10 while the number of passes in the plug of Mark 1 was 2. Moreover, in the piercing-rolling using the plug of Mark 2, since the head member could be easily exchanged, a decrease in rolling efficiency was prevented.

The embodiments of the present invention are described above. However, the above-described embodiments are only examples for exemplifying the present invention. Accordingly, the present invention is not limited to the above-described embodiments only, and the above-described embodiments can be appropriately modified within the scope of the invention.

BRIEF DESCRIPTION OF THE REFERENCE SYMBOLS

1: piercing machine
11 to 15 and 17: plug
21, 22, 24, 25, and 27: head member
31, 32, 34, 35, and 37: plug main body
CO1, CO2, CO4, CO5, and CO7: column-shaped portion
HO1, HO2, HO4, HO5, and HO7: joining hole
JP21, JP22, JP24, JP25, JP27, JP31, JP32, JP34, JP35, and JP37: joint portion

The invention claimed is:

1. A plug for hot pipe making which is used in hot pipe making of a seamless pipe, the plug comprising:
a pair of plug pieces which is attachable to and detachable from one another; and
a connection member which connects the plug pieces,
wherein one of the plug pieces includes a column-shaped portion which extends in a direction of an axis of the plug for hot pipe making, and the other of the plug pieces includes a joining hole which extends in the direction of the axis of the plug for hot pipe making and into which the column-shaped portion is inserted, and
wherein the connection member is a permanent magnet which is attached to at least one of the column-shaped portion and the joining hole.

2. The plug for hot pipe making according to claim 1,
wherein cross-sectional shapes of the column-shaped portion and the joining hole are circles.

3. The plug for hot pipe making according to claim 1 or 2,
wherein the connection member is attached to a surface of an outer circumference of the column-shaped portion of one of the plug pieces, and
wherein the joining hole is formed in a ferromagnetic body which is at least a portion of the other of the plug pieces.

4. The plug for hot pipe making according to claim 3,
wherein one or more connection members are disposed around the axis of the plug for hot pipe making in the surface of the outer circumference of the column-shaped portion.

5. The plug for hot pipe making according to claim 3,
wherein the connection member is attached at a position away from an end of the column-shaped portion.

6. The plug for hot pipe making according to claim 3,
wherein a groove is formed on surface the surface of the outer circumference of the column-shaped portion, and
wherein the connection member is fitted to the groove so that a gap is generated between a surface of the connection member and an opening surface of the groove.

7. The plug for hot pipe making according to claim 1 or 2,
wherein the connection member is attached to an end surface of the column-shaped portion of one of the plug pieces, and
wherein the joining hole is formed in a ferromagnetic body which is at least a portion of the other of the plug pieces.

8. The plug for hot pipe making according to claim 7,
wherein a mounting hole is formed on the end surface of the column-shaped portion, and
wherein the connection member is inserted into the mounting hole so that a gap is generated between a surface of the connection member and an opening surface of the mounting hole.

9. The plug for hot pipe making according to claim 1 or 2,
wherein the connection member is attached to a surface of an inner circumference of the joining hole of the other of the plug pieces, and
wherein at least the column-shaped portion of one of the plug pieces is formed by a ferromagnetic body.

10. The plug for hot pipe making according to claim 9,
wherein one or more connection members are disposed around the axis of the plug for hot pipe making in the surface of the inner circumference of the joining hole.

11. The plug for hot pipe making according to claim 9,
wherein the connection member is attached at a position away from an opening end of the joining hole.

12. The plug for hot pipe making according to claims 9,
wherein a groove is formed on the surface of the inner circumference of the joining hole, and
wherein the connection member is fitted to the groove so that a gap is generated between a surface of the connection member and an opening surface of the groove.

13. The plug for hot pipe making according to claim 1 or 2,
wherein the connection member is attached to a bottom surface of the joining hole of the other of the plug pieces, and
wherein at least the column-shaped portion of one of the plug pieces is formed by a ferromagnetic body.

14. The plug for hot pipe making according to claim 13,
wherein a mounting hole is formed on the bottom surface of the joining hole, and
wherein the connection member is inserted into the mounting hole so that a gap is generated between a surface of the connection member and an opening surface of the mounting hole.

* * * * *